US006428374B1

(12) United States Patent
Nuss

(10) Patent No.: US 6,428,374 B1
(45) Date of Patent: Aug. 6, 2002

(54) FLANGE FOR MARINE HEAT EXCHANGER

(75) Inventor: W. Philip Nuss, Covington, LA (US)

(73) Assignee: Halter Marine, Inc., Gulfport, MS (US)

( * ) Notice: Subject to any disclaimer, the term of this patent is extended or adjusted under 35 U.S.C. 154(b) by 0 days.

(21) Appl. No.: 09/666,872

(22) Filed: Sep. 20, 2000

(51) Int. Cl.[7] ..... B63H 21/10
(52) U.S. Cl. ..... 440/88
(58) Field of Search ..... 440/88, 89, 112

(56) References Cited

U.S. PATENT DOCUMENTS 4,043,289 A * 8/1977 Walter ..... 440/88
4,820,214 A * 4/1989 Lefeber ..... 440/88
4,991,546 A 2/1991 Yoshimura

* cited by examiner

*Primary Examiner*—Stephen Avila
(74) *Attorney, Agent, or Firm*—Len R. Brignac

(57) ABSTRACT

A marine engine fresh water cooling system and a marine vessel using a coolant system for use on double bottomed hulls or single hulled vessels which has a unique flange and bushing combination.

7 Claims, 4 Drawing Sheets

FLANGE FOR MARINE HEAT EXCHANGER

BACKGROUND OF THE INVENTION

This invention relates to an improved device for cathodic protection of dissimilar metals on heat exchangers for fresh water cooling of marine engines.

As is well known, internal combustion engines are frequently employed for powering watercraft. It is the normal practice, particularly in connection with inboard engines, that engine coolant water is cooled by circulating the hot water through a heat exchanger secured to the exterior of the hull using flanges. Sea water cools the hot engine water while contained within the heat exchanger thereby providing cooler water which is then recirculated back to the engine, see, for example, U.S. Pat. 4,991,546 which is incorporated by reference.

These heat exchanges are very helpful, but difficulty has existed in the flange attachment for a double-hulled ship, because of corrosion. The present invention has been developed to reduce corrosion and improve cathodic protection for the flange used to secure the heat exchanger outlet to a vessel.

SUMMARY OF TIRE INVENTION

The invention relates to a cooling system for a fresh water cooled marine engine, comprising of a heat exchanger disposed in seawater for cooling heated fresh water from a marine engine; an inlet to said heat exchanger for receiving heated fresh water from said marine engine; an outlet from said heat exchanger for discharging cooled fresh engine water from said heat exchanger; said outlet having a central conduit, a gasket, a flange, a plurality of studs and a bushing; said outlet passing through a hull of a vessel; and said studs being covered by a bushing having a tube and a faceplate The invention also relates to a vessel having a marine engine is provided with which fresh water is used as coolant for the engine and then circulated by means of cooling pump to a heat exchanger. Heated fresh water is passed from the engine into a conduit to the heat exchanger by means of this pump. The pump delivers the hot water to an inlet for the engine heat exchanger, as which is affixed to the hull of the boat. A flange is used to secure the inlet conduit. The heated fresh water circulates through an external heat exchanger, which cools the hot water by exposure to seawater in which the engine water heat exchanger is located.

The heated fresh engine water does not mix in the seawater in which the vessel is operating and once cooled, the cooled fresh water is circulated back into the engine through a second port, which is flanged, to the hull.

The present invention relates to an improved flange construction for use to and from the heat exchanger having a unique bushing for securing the flange to the hull.

It is an object of this invention to provide an improved cooling system for a marine engine that will be easily installed in single or double hulled vessels to reduce corrosion and still insure a proper and good seal between the heat exchanger and the hull.

DETAILED DESCRIPTION OF THE PREFERRED EMBODIMENTS

Figure 1:
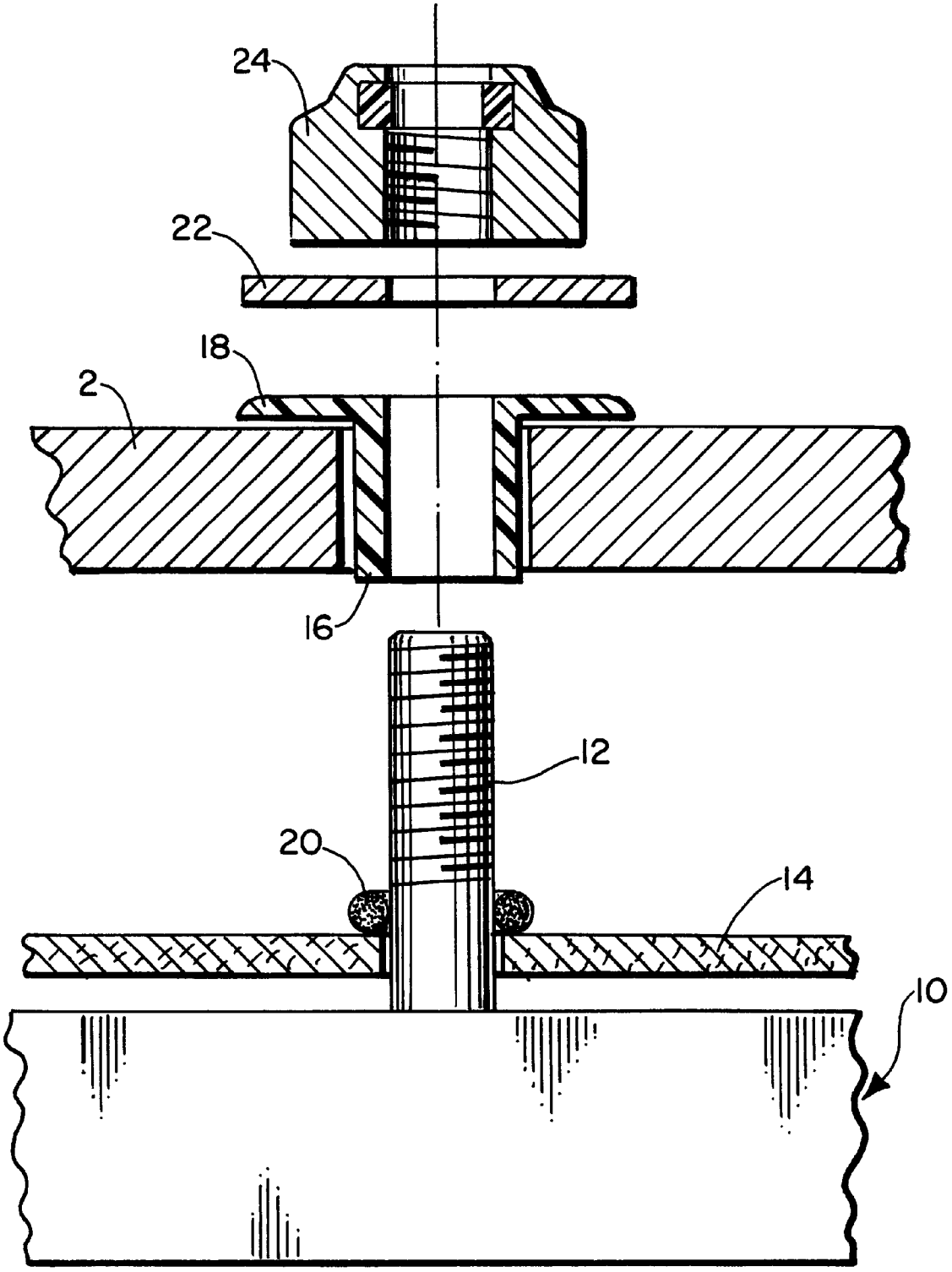
FIG. 1 is an expanded view of the bushing and flange system.
Figure 2A:
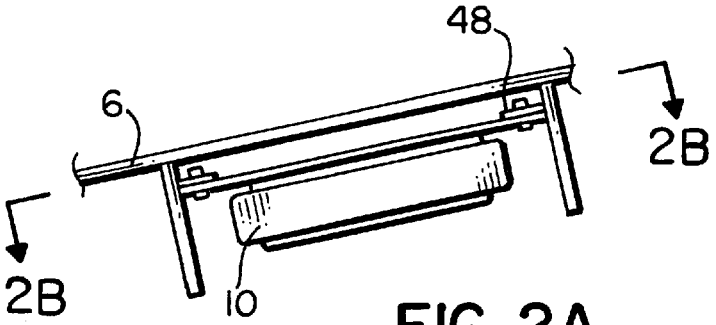
FIG. 2 is a detailed view of the flange and stud combination usable on the bottom of a vessel.
Figure 2B:
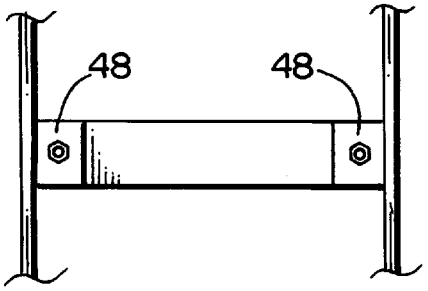
Figure 2C:
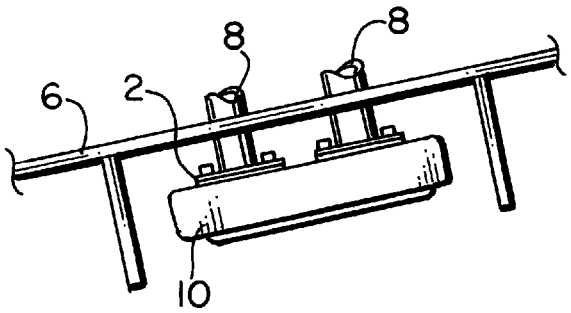
Figure 2D:
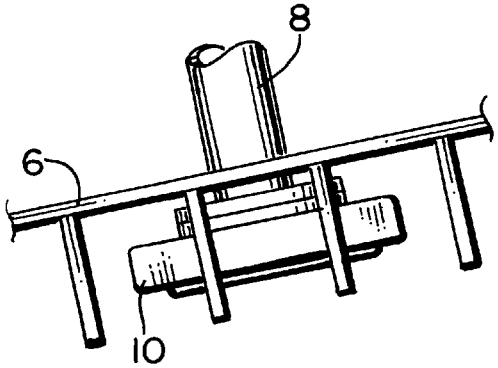

Referring to FIG. 1, the heat exchanger flange 2 has a plurality of studs 12 for securing the heat exchanger to the hull of a vessel. FIG. 2 shows a hull 6 through which the outlet conduits 8 pass. The outlet conduits contain the cooled engine water from the heat exchanger 10. In the most preferred embodiment, the heat exchanger flange 2 is approximately 1 inch thick, but the flange can range in thickness from 0.5 inches to 3 inches in thickness and remain usable in this invention. In the preferred embodiment, the heat exchanger flange 2 is made from a corrosion resistant material. Other coated metals can be used, and graphite composites may even be usable in the present invention.

Returning to FIG. 1, the flange 2 has a plurality of holes for receiving studs 12 from the heat exchanger 10. In a preferred embodiment, a gasket 14, such as a ⅛ inch gasket by Femstrum is disposed between the heat exchanger 10 and the flange 2. Over the stud 12 is disposed a one piece bushing having a tube 16 and a face plate 18. The bushing is preferably made of a phenolic compound or strong composite material. The shaft 16 extends entirely over the stud 12 to the gasket 14 thereby preventing cathodic degradation, and the deterioration of the flange 2 due to exposure to a corrosive environment. The bushing is hollow and can be secured using a bead 20 of permatex red, or other similar non-hardening sealant between the edge of the bushing that meets the gasket and the stud.

Over the bushing plate 18, a flat washer 22, preferably a phenolic compound or nylon can be placed and secured with a nut or similar tightening means 24. In the most preferred embodiment, a nylok nut can be used, such as those provided from Fermnstrum.

Additionally, locktite, or a similar non-hardening sealant can be placed over the ends of the stud 12 which engages the nut 24. In the most preferred embodiment, the non-hardening blue sealant can be used.

The stud can be threaded for engagement with the nylok nut. In the most preferred embodiment, the stud has about one inch to two inches of threads for securing to the nut.

Figure 3:
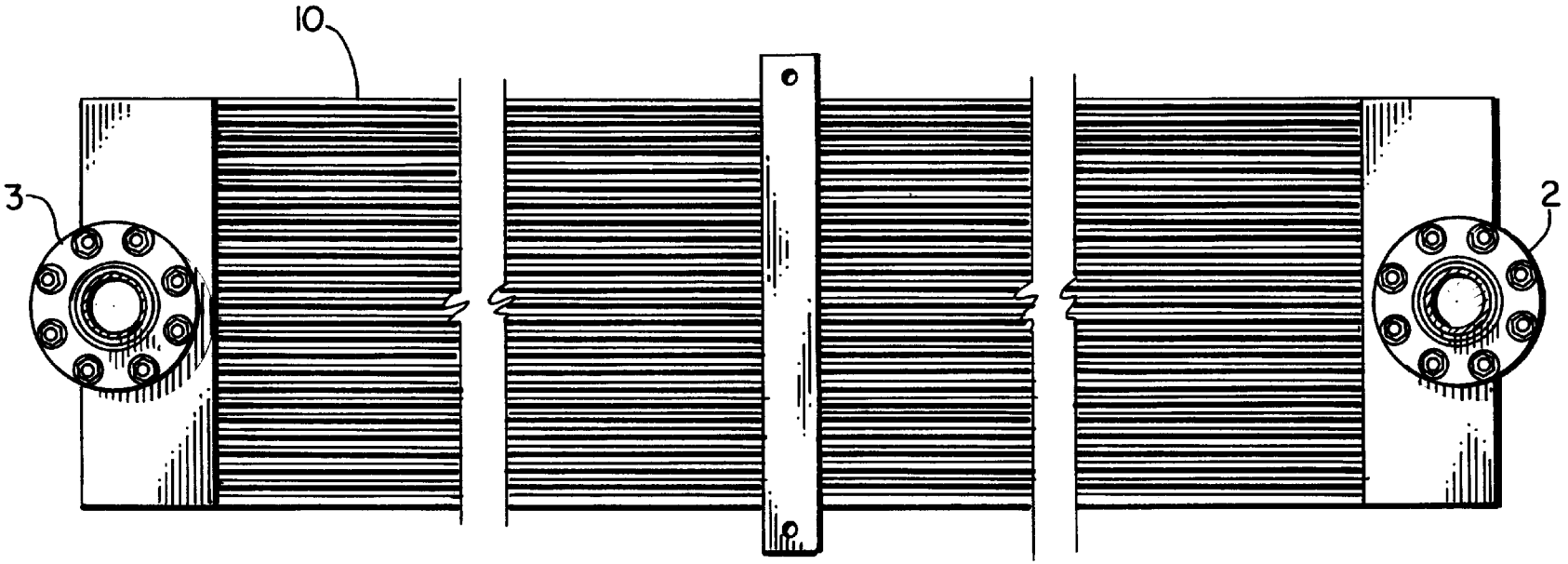
FIG. 3 is a top view of the engine fresh water marine engine heat exchanger, showing the flange and stud combination.

FIG. 3 shows the heat exchanger 10 secured with two identical flanges 2 and 3.

Figure 4:
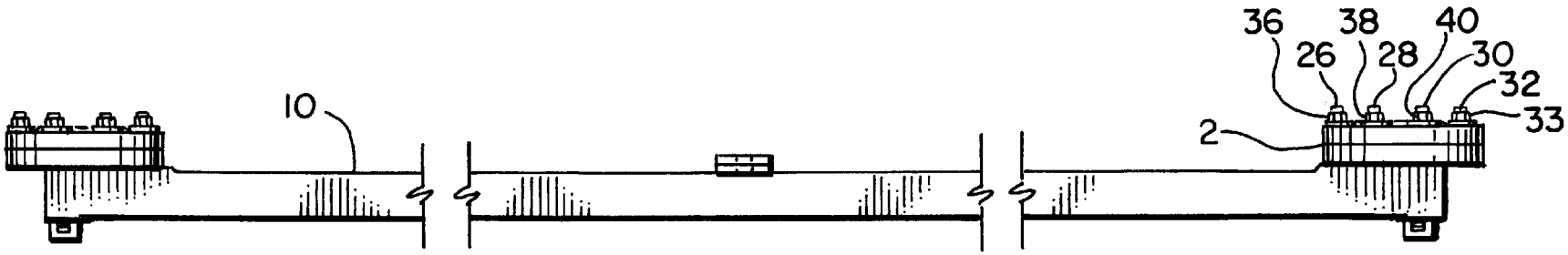
FIG. 4 is a side view of the plange of FIG. 3.

FIG. 4 shows a side view of the mating flange 2 secured to the hull of the vessel 6, as shown in FIG. 2. In this side view, the flange is shown with 4 studs visible, 26, 28, 30 and 32. In one embodiment, the studs each have a nut, 34, 36, 38 and 40 which is preferably a lock nut. In a preferred embodiment, the flange has 8 studs, each 3 inches long spaced apart in equal distances. However, a flange with various numbers of studs can be used depending on the size of the flanges. The mating flange 2 can be a carbon steel with the ability to slip onto a 4 inch pipe with a 4.57 inch ANSI pipe.

The invention is specifically directed to a marine vessel, comprising of a fresh water cooled engine; a heat exchanger for cooling the fresh water from the fresh water cooled engine, said heat exchanger being fixed to the exterior of the hull of said marine vessel using support means; a flange system for affixing said heat exchanger to said vessel hull comprising of a flange, a plurality of studs, a plurality of bushings, each bushing covering each stud, each bushing having a tube and a face plate, and wherein said tube extends the entire length of said stud; a plurality of gaskets, each gasket disposed between said bushing and said heat exchanger; a plurality of lock nuts, each lock nut for securing each bushing and flange into said stud.

Figure 5:
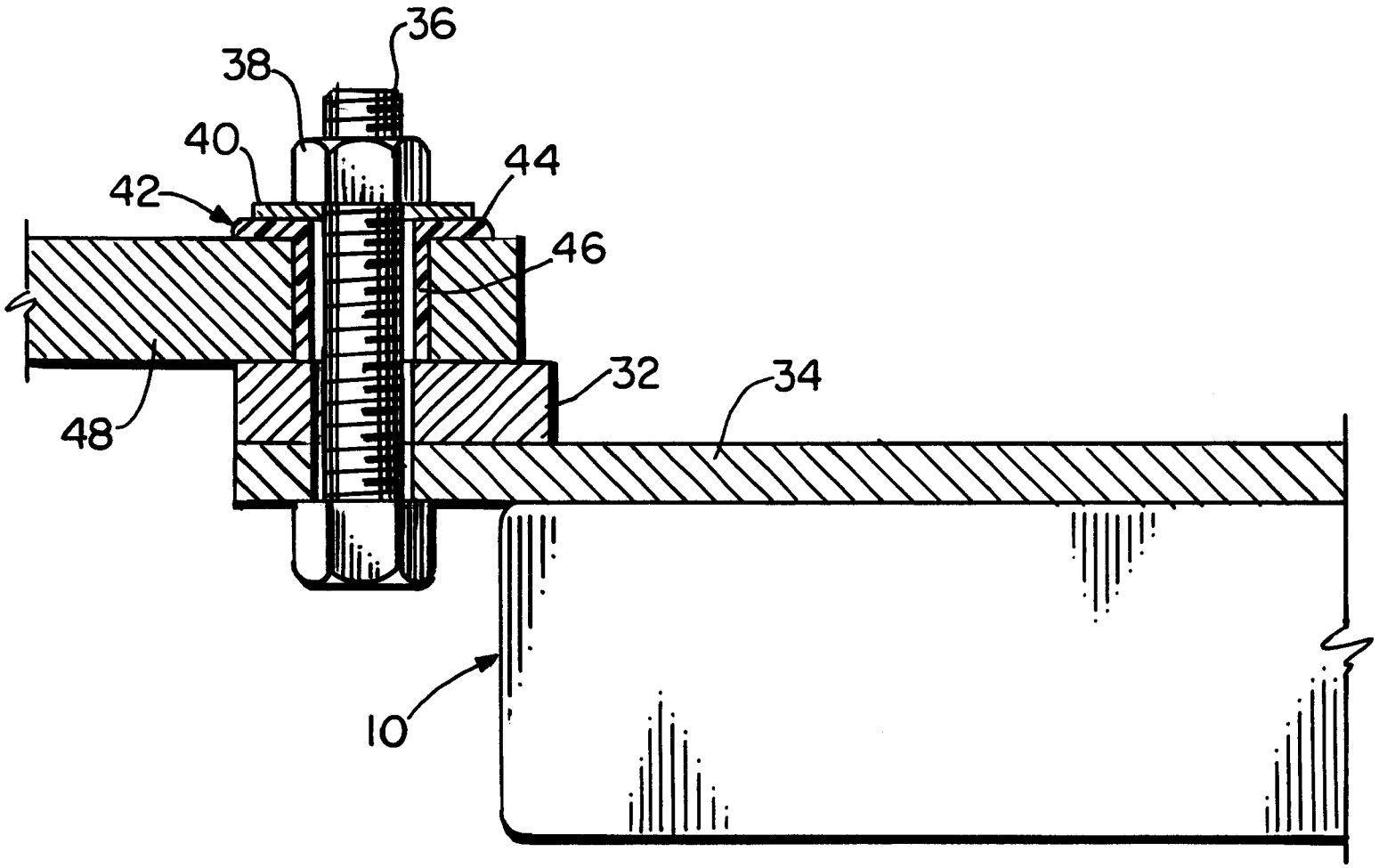
FIG. 5 is a side view of the intermediate attaching means using the bushing of the present invention.

Additionally, the heat exchanger include intermediate support members as shown in FIG. 5. FIG. 5 shows heat exchanger 10, a gasket 32, and the intermediate support member 34. A bolt 36 with a nut 38, which is preferably a lock nut, holds a washer 40 on top of flanged bushing 42 top of flanged bushing 42 which has a one piece construction of a face plate 44 and a tube 46. The bolt attaches to a clip 48 extended from the hull of a ship. In this embodiment, the lock nut is preferably stainless steel and the washer 40 and flanged bushing 42 are phenolic material, such as nylon. The tube 46 extends the length of the bolt 36 to the gasket 32.

Sealant, preferably non-hardening can be used between the flanged bushing and the gasket, and the bolt and nut.

It should be readily apparent from the foregoing description that the embodiments of the invention illustrated and described are very effective in insuring an adequate cathodic protected cooling system for a marine engine. Although a number of embodiments of the invention have been illustrated and described, various changes and modifications may be made without departing from the spirit and scope of the invention, as defined by the appended claims.

What is claimed is:

1. A marine vessel, comprising:

a fresh water cooled engine;

a heat exchanger for cooling the fresh water from the fresh water cooled engine, said heat exchanger being affixed to the exterior of the hull of said marine vessel using support means;

a flange system for affixing said heat exchanger to said vessel hull comprising:

a flange, a plurality of studs, a plurality of bushings, each bushing covering each stud, each bushing having a tube and a face plate, and wherein said tube extends the entire length of said stud;

a plurality of gaskets, each gasket disposed between said bushing and said heat exchanger;

a plurality of lock nuts, each lock nut for securing each bushing and flange into said stud.

2. The vessel of claim 1, wherein the bushing is a phenolic compound.

3. The vessel of claim 1, wherein the heat exchanger can be secured to the hull of the vessel using an intermediate support, comprising:

support means extending from said hull;

a clip for engaging said support means;

a plurality of bolts engaging said heat exchanger and said clip;

a plurality of gaskets, each gasket disposed between said clip and said heat exchanger;

a plurality of flanged bushings each having a tube and a face plate, each flanged bushing covering each of said bolts;

a plurality of washers, each washer disposed around each of said bolts, and on said flanged bushing; and a plurality of nuts wherein said nut is for securing each bolt.

4. The vessel of claim 3, wherein said flanged bushing and washer consist of a phenolic compound.

5. The vessel of claim 3, wherein said support means is metal.

6. The vessel of claim 1, wherein a non-hardening sealant is disposed between the bushing and the gasket.

7. The vessel of claim 1, wherein a non-hardening sealant is disposed between the stud and the nut.

* * * * *